United States Patent [19]

Grind

[11] 3,996,634

[45] Dec. 14, 1976

[54] SECTIONAL BOAT

[76] Inventor: Robert E. Grind, 512 Fairview Drive, Placerville, Calif. 95667

[22] Filed: Nov. 24, 1975

[21] Appl. No.: 634,788

Related U.S. Application Data

[63] Continuation-in-part of Ser. No. 474,611, May 30, 1974, abandoned.

[52] U.S. Cl. ..... 9/2 S; 151/69

[51] Int. Cl.[2] ..... B63B 7/04

[58] Field of Search ..... 9/2 S, 2 R, 2 C; 114/77 R; 151/69

[56] References Cited

UNITED STATES PATENTS

| | | | |
|---|---|---|---|
| 1,209,460 | 12/1916 | Lowe | 151/69 |
| 1,578,472 | 3/1926 | Sawyer | 9/2 S |
| 3,266,067 | 8/1966 | Windle | 9/2 S |
| 3,400,414 | 9/1968 | Windle | 9/2 S |
| 3,816,865 | 6/1974 | Ragan | 9/2 S |
| 3,883,909 | 5/1975 | Fisher et al. | 9/2 S |

FOREIGN PATENTS OR APPLICATIONS

| | | | |
|---|---|---|---|
| 960,460 | 4/1950 | France | 9/2 S |

*Primary Examiner*—Trygve M. Blix
*Assistant Examiner*—Stuart M. Goldstein

[57] ABSTRACT

A multiple section boat, each section being separately buoyant, and preferably the sections being sized to nest in storage; adjacent sections being attached at the bottom for tension loads by a plurality of upstanding hook-like tabs on the forward section fitting into slots on the bottom of the next rearward section; screw clamps attaching the tops of adjacent sections; and spacer strips, for compression loads, positioned between adjacent sections.

13 Claims, 5 Drawing Figures

SECTIONAL BOAT

This is a continuation in part of application Ser. No. 474,611, filed 5/30/74, and now abandoned.

BACKGROUND OF THE INVENTION

The sectional boat art is characterized, for example, by the following U.S. patents.

U.S. Pat. No. 2,650,376 issued Sept. 1, 1953, to B. L. Sommer, pertains to a sectional boat in which the sections nest for storage. The connections or interface between adjacent boat sections interlock to form a substantially rigid boat. The adjacent sections are bolted together.

U.S. Pat. No. 2,741,782 which issued Apr. 17, 1956 to O. A. Muller, pertains to multiple section boat which apparently is clamped together by toggle clamps, or the like. Details of the actual connection are not available.

U.S. Pat. No. 2,879,525 which issued Mar. 31, 1959 to J. W. Fitzgerald is for a sectional boat wherein the parts or sections are bolted together with a particular-shaped bolt.

U.S. Pat. No. 2,977,607 issued Apr. 4, 1961 to J. R. Roblee for a sectional boat which is adapted to be carried upon a hiker's back. The sections nest, and adjacent sections are held together with bolts and wing nuts.

U.S. Pat. No. 3,266,067 issued Aug. 16, 1966 to W. W. Windle for a sectional boat wherein the bottoms of the adjacent sections are held together by upstanding posts on one section fitting into holes on the adjacent section, and including spacing between adjacent sections.

U.S. Pat. No. 3,381,322 issued May 7, 1968 to W. A. Cook for a sectional boat wherein adjacent sections are connected by cable for tension loads on the boat.

U.S. Pat. No. 3,400,414 issued Sept. 10, 1968 to W. W. Windle teaches a sectional boat wherein the boat sections are held together with upstanding pyramidal studs fitting into slots on the forward end of the bottom of the next rearward section.

U.S. Pat. No. 3,594,834 issued July 27, 1971 to R. D. Steensen for a sectional boat wherein the sections are clamped together with special clamps.

The above-described sectional boats suffer from alignment and stress-concentration problems, difficulty in manufacturing and difficulty in assembly which the apparatus of this application is designed to overcome.

BRIEF DESCRIPTION OF THE INVENTION

The apparatus contemplated by this invention pertains to a means for fastening together sections of a sectional boat. The invention may be used in sail boats and runabouts, for example, fishing boats, rowing boats, and the like, perhaps up to 14 to 16 feet in length. It is not intended, however, that the invention is to be limited to boats of that length.

The boat may be constructed of various materials such as fiber-glass, aluminum and wood. It may also be fabricated of other plastics and building materials.

The apparatus has two connecting assemblies; a bottom clamp which holds two sections of the boat together at the bottom and forms, in effect, a continuous bottom to the assembled boat. When in the water and loaded, this assembly is under a pure tension load. The second assembly is a plurality, usually two, special attachment bolt-assemblies which carry principally shear loads between adjacent sections. Spacer strips are positioned between adjacent boat sections to serve as a fulcrum and as a forceloading adjustment that keeps the bottom clamp under tension loading, and also serves to receive compression loads between the adjacent sections.

It is therefore an object of this invention to connect sections of a sectional boat.

It is a specific object of this invention to connect sections of such a boat with special connectors, each taking a different type of stress: tension, shear and compression.

It is yet a more specific object of the invention to provide a sectional boat having unique means for attaching the sections of the boat together.

BRIEF DESCRIPTION OF THE DRAWINGS

Other objects will become apparent from the following description, taken in connection with the accompanying drawings, in which.

DETAILED DESCRIPTION OF THE INVENTION

The apparatus of this invention is a sectional boat which has its sections connected together with novel attachments dividing the stress generated at the attaching face between the attachments.

Figure 1:
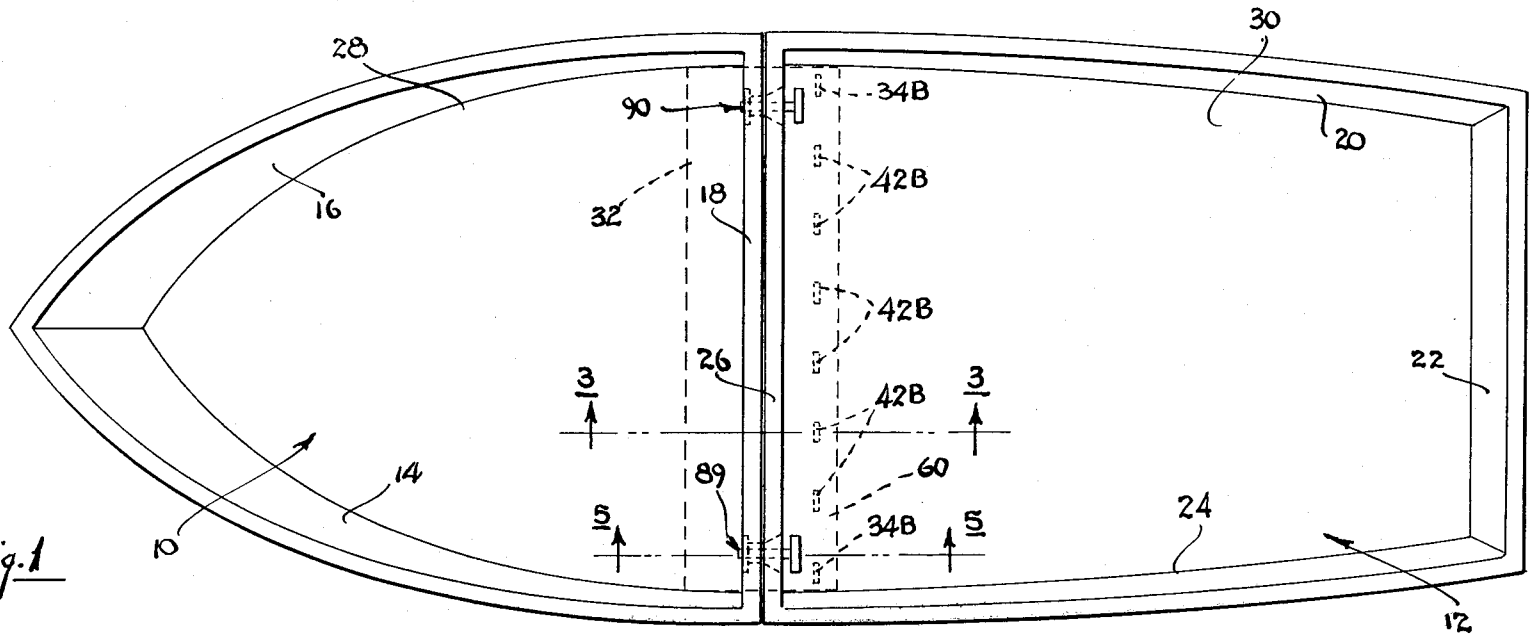
FIG. 1 is a plan view of a typical sectional boat in accordance with the invention.
Figure 2:
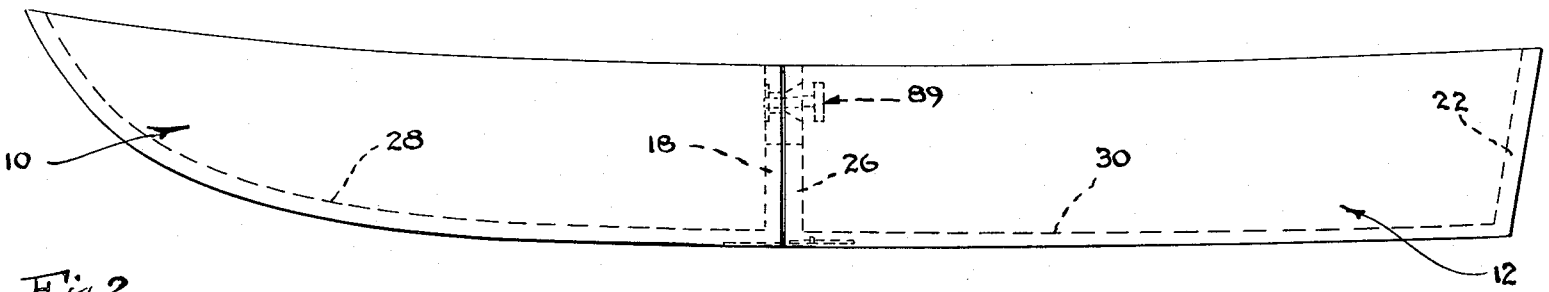
FIG. 2 is a side view of FIG. 1.

Referring to the drawings, FIGS. 1 and 2 show a two-section boat in accordance with this invention. The forward section 10 has separate sides 14, 16, 18 and a bottom 28 which, in itself, floats. Similarly, the rearward section 12 has sides 20, 22, 24, 26 and a bottom 30 which allow it to float.

The two sections 10, 12 are attached together at the top by special bolt-type connector assemblies 89, 90 which will be explained in detail below. The sections 10, 12 are also connected together at the bottom by a plurality of slots 34B, 42B, and corresponding hook-like tabs 34A, 42A. Watertight integrity is protected by preventing the slots 34B, 42B from penetrating the entire bottom 30.

Between the rearward side 18 of the forward section 10 and the forward side 26 of the rearward section 12 are a plurality of spacer strips 80, 82 as described below to establish a preloading in the lower clamp and to take compression loads between the sections 10, 12.

Typically, the boat sections are fabricated of fiber-glass, other plastics or light weight metal material with stronger inserts where needed to carry loads. The stronger inserts may be made of metal. Further, it is within the contemplation of this invention that the entire boat be made of light weight metal with stronger inserts. The boat will be described, however, as if it were made of fiber-glass with metal inserts.

Figure 3:
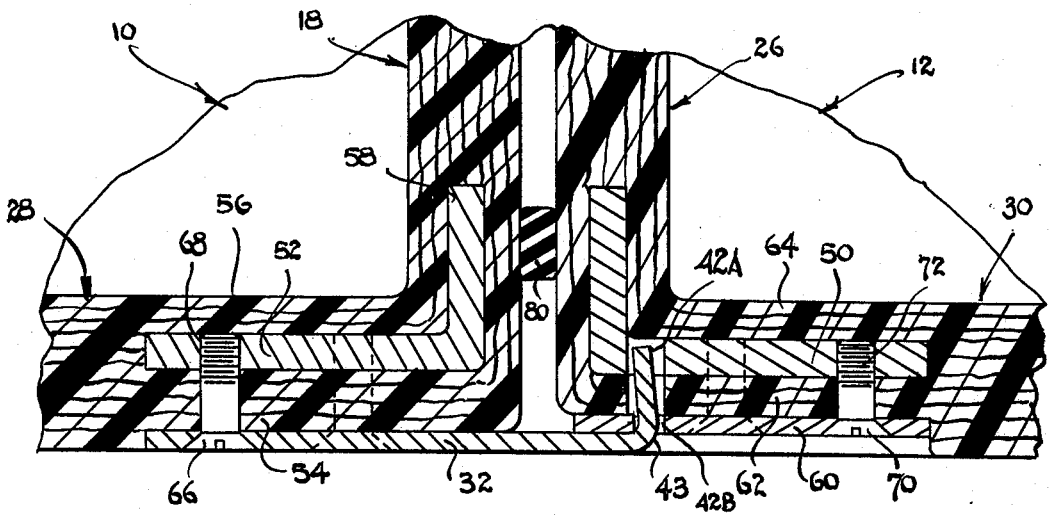
FIG. 3 is a sectional view taken at 3—3 in FIG. 1.

The section 10 is typically of fiber-glass, and the portions of 56, 54 of FIG. 3 are of that material. Bonded within the fiber-glass is an angle iron 52 having an upstanding portion 58 and a plurality of screw holes 68 for receiving attaching screws 66. Angle iron 52 serves to receive the bottom clamp loads and to distribute these loads uniformly across the entire bottom skin of the boat. If the boat section 10 were of sufficiently strong material, such as metal, the screws 66 would be screwed directly into the metal, and the extra metal member 52 would not be required. Water tight integrity is caused by making the fiber-glass water tight.

The planar member or plate, 32, is screwed onto the rearward end of the bottom 28 of the section 10 as shown in FIG. 3, and the screws 66 pass through holes in the plate 32, through the portion 54 of fiber-glass into the screw holes 68 in the anchoring member 52. The plate 32, when attached to the bottom 28, is preferably flush with the bottom 28, and the bottom is preferably recessed to receive plate 32.

The rearward portion 12 is also preferably of fiberglass, and the portion 64, 62 while sealing the bottom 30 also enclose the anchoring member 50. Member 50 is identical in function and substantially identical in shape to member 52 except that it has a row of slots therein substantially aligned athwart the boat and aligned with corresponding slots 34B, 42B to provide clearance for tabs 34A, 42A. Openings are also provided in the portion 62 in alignment with the slots 34B, 42B.

The planar member or plate, 60, is attached to the forward end of the bottom 30 of the rearward section 12. The plate 60 is screwed onto the bottom 30 by screws 70 which are attached to the anchoring member 50. Slots are provided in the plate 60 substantially in alignment with slots 34B and 42B to receive the upstanding tabs. There is one difference in the slots in plate 60 and the slots in member 50 in that the tabs 34A, 42A do not contact the walls of the slot in plate 50 nor the corresponding slots in the portion 62, but the tabs 34A, 42A do contact the foreward walls of the slots 34B, 42B in the plate 60 so that the tension longitudinal loads on the clamp are carried at the root of the bend of the upstanding tabs 34A, 42A.

The upstanding, hook-like tabs are planar in shape, enabling the primary load-carrying surface to be the forward face of the tabs. The tabs are inclined forward at the top so that, under tension loading in plates 60 and 32, plate 60 will be forced downward firmly against plate 32, and the engagement at the root of the tabs will be insured. This form of contact between plates 60 and 32 is necessary so that the mode of force application will be essentially tensile in nature, eliminating any tendency for the tabs to straighten out or for plates 60 and 32 to bend either upward or downward.

Figure 4:
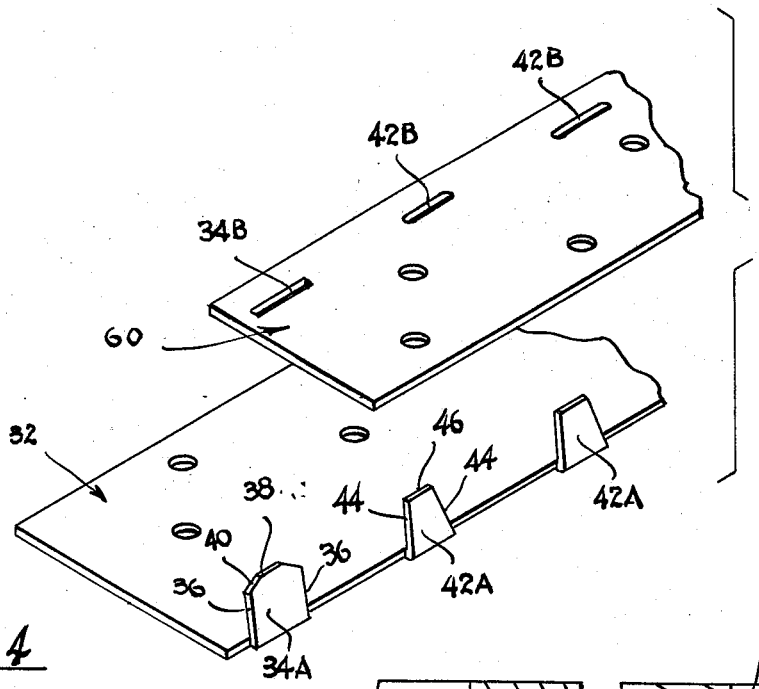
FIG. 4 shows a pair of interconnecting clamps or connectors for bottom connectors of the sections of the boat of FIGS. 1 and 2.

Note that the tabs 34A are different in shape than the tabs 42A as shown in FIG. 4. During assembly the tab 34A aligns the boat sections transverse of the boat center line. The tabs 42A have sides which taper toward the top so that the ends of the tab do not contact the corresponding slot ends.

Figure 5:
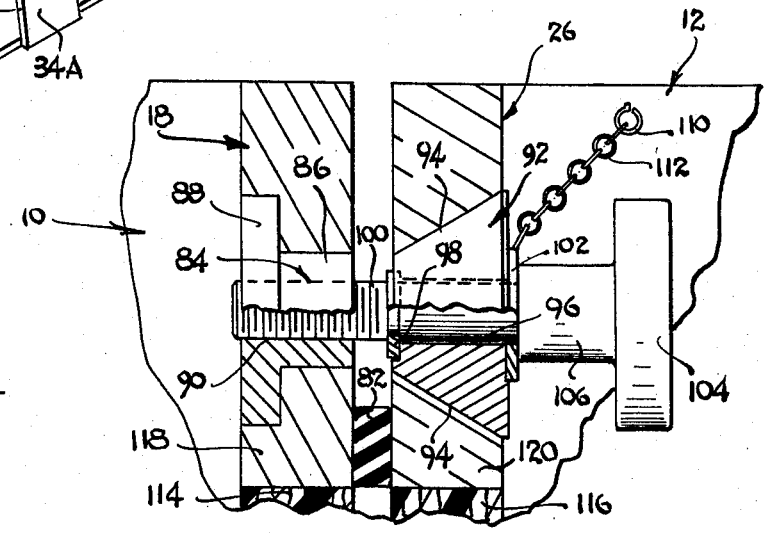
FIG. 5 is a sectional view taken at 5—5 in FIG. 1.

Between the walls 18 and 26 in the region of the lower clamp is a strip, 80, extending substantially across the boat and which serves as a fulcrum or pivot such that, when part 104 of the top clamp in FIG. 5 is pulled in tight, plates 60 and 32 are forced into a preload of a tension mode. Strip 80 also performs in transmitting compression loads between boat sections 10 and 12 in the region of the lower clamp and prevents plates 60 and 32 from becoming un-loaded or loose.

The upper edges of the sides 18, 26 have metal portions 118, 120 which are adapted to carry loads and which are bonded to the fiber-glass portions. In an aluminum boat, the portions 118, 120 would not need to be separate, nor would that be necessary if the fiberglass or other plastics construction material were sufficiently strong.

The attaching bolts 89, 90 are shown in detail in FIG. 5. A flanged machine nut 84 having a flange 88 and body 86 is imbedded into the material 118 and rigidly attached thereto. The nut 84 has threads on its bore. A tapered plug 92 fits into a tapered bore 94 in the material 120. The plug 92 preferably has no threads on its bore, and a handwheel 104 is attached to a shank 106 which has a threaded portion 100 extending through the washer 102, the plug 92, the retainer-washer 98 and into the bore of the nut 84. The washers 98, 102 help hold the plug 92 onto the shank 106. A chain 112 connects the washer 102 to a cleat 110 which is fastened to the boat side. The tapered plug 92 causes the tops of the two sections to be aligned and to doubly ensure a snug vertical contact of the tabs 34A, 42A with plate 60 so that longitudinal loads are carried only at the roots of the bend of the tabs.

Between the walls 18 and 26 in the region of the upper clamp is a strip, 82, extending substantially across the boat, which serves as a spacer to establish and maintain the proper amount of separation between the walls 18 and 26 at the top. Strip 82 will be of the correct thickness to maintain proper pre-tension between plates 60 and 32, and will serve as an adjustment feature to compensate for manufacturing tolerance variations. Strip 82 also performs in transmitting compression loads between boat sections 10 and 12 in the region of the upper clamp.

In assembling the boat, the tabs 34A, 42A engage the corresponding slots 34B, 42B, the plug 92 is inserted, and the hand wheel 104 (on both attachments 89 and 90) are tightened to bring the roots of the tabs 34A, 42A up tight against the forward side of the slots in the plate 60.

Both static and dynamic loading on the boat tends to cause one section of the boat to rise relative to the other. The up and down shear forces are resisted by the bolt-type conical plugs 89, 90. The side shear forces are resisted by the plugs 89, 90. Compression loads due to bending, and the like are resisted by the fulcrum 80, and by spacer 82. Tension loads are taken by the tabs 34A, 42A and by the plate 60, and are distributed by angles 50 and 52 into the adjoining boat sections.

Thus, a novel multi-sectional boat has been provided wherein the stresses are separately resisted by novel connectors and fittings between the sections. Although the invention has been described in detail above, it is not intended that the invention shall be limited by that description, but that the following claims shall also be part of the description of the invention.

I claim:

1. A multiple section boat comprising:

a plurality of boats sections, each having at least a bottom and a plurality of boat sides, each section being separately buoyant;

the rearward boat side of each section, except the rearward most section, being attachable to the forward boat side of the next adjacent rearward section;

the forward boat side of each said section, except the forward-most section, being attachable to the rearward boat side of the next adjacent forward section;

a plurality of spacer strips between said adjacent attachable boat sides;

a bolt means for attaching said adjacent boat sides and for carrying vertical shear forces between said adjacent boat sides;

slot means in the forward end of the bottom of each said section except in the forward-most section;

a fixture having upstanding tabs thereon, extending from the rearward end of the bottom of each said section except the rearward-most section, said tabs being aligned with a plurality of slots in said slot means on the next adjacent said section and being bent forward to engage said slots at the root of the bend of said upstanding tabs to carry tension forces between said adjacent sections.

2. A multiple section boat comprising:

a plurality of boat sections, each having at least a bottom and a plurality of boat sides, each section being separately buoyant;

the rearward boat side of each section, except the rearward-most section, being attachable to the forward boat side of the next adjacent rearward section;

the forward boat side of each said section, except the forward-most section, being attachable to the rearward boat side of the next adjacent forward section;

a plurality of spacer strips between said adjacent attachable boat sides;

a bolt means having two flanged machine nuts substantially rigidly attached to the top portion of the rearward side of the forward section of two said attaching sections and each having a fore-and-aft directed threaded bore;

two tapered conical plugs positioned in two tapered conical bores in the forward side of the rearward section of two attaching sections and each having a fore-and-aft directed non-threaded bore, the taper of said conical plugs and bores matching and tapering from large to small toward the front of said sections;

said machine nuts and plugs being positioned in port and starboard positions of their respective boat sides and with their bores substantially aligned;

two handwheels attached to threaded shanks of sufficient length to extend through said bores of said plugs, between said adjacent sections, and into said threaded bores of said machine nuts;

slot means in the forward end of the bottom of each said section except in the forward-most section;

a fixture having upstanding tabs thereon, extending from the rearward end of the bottom of each said section except the rearward-most section, said tabs being aligned with a plurality of slots in said slot means on the next adjacent said section and being bent forward to engage said slots at the root of the bend of said upstanding tabs to carry tension forces between said adjacent sections.

3. A boat as recited in claim 2 in which said spacer strips comprise two elongated members extending substantially across said boat, one member being positioned adjacent to the bottom of said boat and serving as a fulcrum to pre-tension contact between said tabs and said slots and to carry compression forces between said adjacent sections; and the other spacer strip being positioned adjacent to the top of said boat to establish the amount of said pre-tension and to carry compression forces between said adjacent sections.

4. A boat as recited in claim 3, wherein said spacer strips have a substantially rectangular cross section.

5. A boat as recited in claim 2 and further comprising retaining washers on said shanks at opposite ends of said bores of said plugs for retaining said plugs on said shanks, and means for flexibly connecting said washers, plugs, shanks, and handwheels to said boat.

6. A boat as recited in claim 5 in which said means for flexibly connecting comprises a chain attached to one of said washers and to said boat.

7. A boat as recited in claim 2 in which said boat sections are of plastic material and said machine nuts are embedded into said plastic material.

8. A boat as recited in claim 2, wherein said slot means comprises a first planar member or plate of high strength material attached to each of the forward ends of the bottom of each said section, except the forward-most section, recessed into the bottom of the boat section to which it is attached, containing a row of elongated slots across said boat, said fixture comprising a second mating planar member or plate of high strength metal attached to each of the rearward ends of the bottom of each said section, except the rearward-most section, extending outward from the rearward end of said section into the region of the slots in the forward end of said adjacent boat section, said second plate formed at the rearward end to carry said upstanding tabs, said tabs to have a broad, flat, forward-inclined forward face or surface, and having a hook-like function to ensure engagement at the root of said tab with the slots in said first plate, to eliminate upward and downward bending of said first plate when subjected to severe force loading.

9. A boat as recited in claim 8 in which the outboard said tabs have straight sides to align said tabs and slots and to receive sideward-directed shear forces between said two connected sections.

10. A boat as recited in claim 9 in which said outboard tabs have a sliding fit in the outboard-most slots of said plurality of slots.

11. A boat as recited in claim 2 and further comprising an angle iron embedded in the rearward end of each section except the rearward-most section, and said fixture being attached to said angle iron.

12. A boat as recited in claim 11 in which said slot means comprises a metal plate, a second angle iron on each said section except the forward-most section, said metal plate being attached to said second angle iron, and said second angle iron being embedded in said plastic material.

13. A boat as recited in claim 12 in which said second angle iron has a plurality of slots therein aligned with the plurality of slots in said metal plate, the slots in said angle iron being large enough to completely clear tabs inserted therein.

* * * * *